US006499529B1

(12) United States Patent
Farkas

(10) Patent No.: US 6,499,529 B1
(45) Date of Patent: Dec. 31, 2002

(54) CENTRIFUGAL COUNTERGRAVITY CASTING

(75) Inventor: Attila P. Farkas, Milford, NH (US)

(73) Assignee: Hitchiner Manufacturing Co., Inc., Milford, NH (US)

( * ) Notice: Subject to any disclaimer, the term of this patent is extended or adjusted under 35 U.S.C. 154(b) by 0 days.

(21) Appl. No.: 09/932,847

(22) Filed: Aug. 17, 2001

(51) Int. Cl.[7] ..... B22D 13/00; B22D 18/06

(52) U.S. Cl. ..... 164/114; 164/119; 164/63

(58) Field of Search ..... 164/119, 114, 164/115, 116, 117, 118, 306, 307, 308, 286–301

(56) References Cited

U.S. PATENT DOCUMENTS

| | | | | |
|---|---|---|---|---|
| 1,703,739 | A | 2/1929 | Klepsch | |
| 2,450,755 | A | 10/1948 | Higgins | |
| 2,450,832 | A | 10/1948 | Kuhlman | |
| 2,497,160 | A | 2/1950 | Fejmert | |
| 2,997,756 | A | 8/1961 | Strom | |
| 3,672,429 | A | 6/1972 | Lajoye | 164/63 |
| 3,774,668 | A | 11/1973 | Iten et al. | 164/255 |
| 3,863,706 | A | 2/1975 | Chandley et al. | 164/255 |
| 4,392,805 | A | 7/1983 | Golyak et al. | 425/206 |
| 4,660,623 | A | 4/1987 | Ashton | 164/518 |
| 4,763,717 | A | 8/1988 | Lajoye | 164/258 |
| 5,069,271 | A | 12/1991 | Chandley et al. | 164/516 |
| 5,179,995 | A | 1/1993 | Limb | 164/114 |
| 5,626,178 | A | 5/1997 | Merath | 162/272 |

*Primary Examiner*—Kuang Y. Lin

(57) ABSTRACT

Method and apparatus for countergravity casting a plurality of articles wherein a ceramic mold is provided having an upstanding riser passage and a plurality of mold cavities disposed along a length of the riser passage at different elevations, each mold cavity communicating to the riser passage via a gate passage, wherein molten metal is forced to flow upwardly from a source into the riser passage for supply to the mold cavities via their gate passages, wherein the mold is rotated so that molten metal that resides in the gate passages is subjected to centrifugal force in a direction toward the mold cavities, and wherein molten metal in the riser passage is drained to empty the riser passage before molten metal in the mold cavities and the gate passages solidifies, leaving the gate passages at least partially filled with molten metal for supply to the mold cavities in response to shrinkage as molten metal therein solidifies while the container is rotated. The molten metal in the mold cavities is solidified while rotating the container to form a plurality of individual solidified cast articles in the mold cavities.

23 Claims, 13 Drawing Sheets

CENTRIFUGAL COUNTERGRAVITY CASTING

FIELD OF THE INVENTION

The present invention relates to centrifugal countergravity casting of metals and alloys.

BACKGROUND OF THE INVENTION

A countergravity casting process for making investment castings in gas permeable ceramic shell molds is described in U.S. Pat. Nos. 3,863,706; 3,900,064; 4,589,466; and 4,791,977. The ceramic shell mold is formed by the well known "lost wax" process and includes an upstanding riser passage around which are located arrays of mold cavities in the shape of the cast articles to be made. The mold cavities are located along the length of the riser passage from proximate a bottom to a top thereof, and each mold cavity communicates to the riser passage via one or more relatively narrow feed gate passages depending upon the configuration of the mold cavity. The ceramic mold is disposed in a vacuum container, and a fill tube is communicated to the bottom of the riser passage and extends out of the container for immersion in an underlying pool of molten metal. A relative vacuum (subambient pressure) is established in the container when the fill tube is immersed so as to draw molten metal upwardly into the riser sprue and into the gate passages and mold cavities. In typical commercial production practice, the molten metal in the gate passages and mold cavities typically is solidified before the vacuum in the container is released, although U.S. Pat. No. 3,863,706 discloses releasing the vacuum in the container after the molten metal in the gate passages and mold cavities has solidified to produce individual cast articles and to allow return of still molten metal in the riser passage to the underlying pool for reuse.

The ceramic shell mold can be disposed in a particulate support media, such as dry foundry sand, in the vacuum container as described in U.S. Pat. No. 5,069,271. The thickness of the shell mold wall can be reduced by use of the support media in the vacuum container. The container is evacuated using a vacuum head that also compresses the support media about the shell mold as a subambient pressure is established in the container.

Countergravity casting methods result in a large variation in the time that it takes to fill identical mold cavities located at different elevations along the length of the upstanding riser sprue. Depending on such.parameters as location of the mold cavity along the riser passage, gas permeability of the particulate support media, gas permeability of the ceramic shell mold, rate of evacuation of the container, final vacuum level in the container, and others, the time needed to fill mold cavities of the same shell mold can vary by a factor of two or more. For example, the lowermost mold cavities take the longest to fill with molten metal and the uppermost mold cavities take the shortest time. Delayed filling of the lowermost mold cavities can result in incomplete filling thereof with molten metal. Rapid filling of the uppermost mold cavities can result in entrapped gas defects in the solidified cast articles formed in those mold cavities. Unfortunately, attempts to ameliorate one of the these problems (delayed filling or rapid filling) further promotes the detrimental effects of the other.

Countergravity casting methods also result in a large variation in the pressure in the mold cavities. The pressure in each mold cavity is equal to atmospheric pressure pushing on the surface of the molten metal pool when the container is evacuated minus the static pressure of the molten metal in the riser passage that acts counter to the atmospheric pressure on the pool surface. Thus, the pressure in the mold cavities depends on their elevation along the length of the riser passage; more particularly, the pressure depends on the difference in elevation between the surface of molten metal pool and the gate of the mold cavity. The taller the shell mold, the greater is the pressure variation among mold cavities along the length of the sprue. The pressure reduction increases shrinkage and entrapped gas defects in mold cavities located higher up along the riser.

When the molten metal drawn upwardly reaches the closed, upper end of the riser passage, the upper mold cavities may not yet be completely filled with molten metal. When the riser passage is filled to the top end, the molten metal impacts the top end of the riser passage such that there thus is a resulting surge in pressure differential across the gate passages of the upper mold cavities that causes the upper mold cavities to fill too quickly. Much of any gas entrained in the molten metal in the riser passage is carried into the mold cavities where it can remain in the solidified cast articles formed in the mold cavities.

To prevent flow-back of molten metal from the mold cavities and gate passages, the fill tube is kept immersed in the molten pool sufficiently long for the molten metal to solidify in the mold cavities and gate passages. Having to maintain immersion of the fill tube slows the casting cycle time and requires that the mold follow the dropping level of molten metal in the pool such that the mold become more and more exposed to the induction field that is used to heat the pool. The induction field can retard, or reverse, solidification in the mold and distort the container proximate the fill tube in a manner that permits airflow into the lower mold cavities. Gating design becomes a struggle between having gate passages with sufficient volume to feed the mold cavities, yet narrow enough to solidify molten metal in a timely manner therein. Moreover, these constraints on gate design limit the size of cast articles that can be made by the process described in U.S. Pat. No. 3,863,706 to usually less than one pound.

In countergravity casting of large articles, modifications have been made to the method and apparatus to capture molten metal in the riser passage. For example, one modification disclosed in U.S. Pat. No. 4,589,466 involves pinching shut the metal fill tube through which the molten metal is drawn into the mold after the mold is filled. A ceramic coated ball valve or stopper in the fill tube also have been used to this end. Such process is described in U.S. Pat. No. 3,774,668. U.S. Pat. No. 4,961,455 discloses a refinement of the "check valve" by proposing the use of a ferromagnetic, ceramic coated ball forced by magnets to seal the tube through which the melt is drawn. Use of a siphon-trap in the fill tube and inverting of the mold after casting also have been attempted to this end. Use of a ceramic strainer as described in U.S. Pat. No. 4,982,777, or a strainer and convoluted passageway combined as described in U.S. Pat. No. 5,146,973, or a siphon-like passageway alone in the fill tuber as described in U.S. Pat. No. 5,903,762 to retard alloy flow-back from the riser while the mold is inverted have been disclosed. These modifications partially obstruct flow into the riser and result in slow mold filling. All of these processes require solidification of the molten metal in the riser passage, resulting in relatively low utilization of molten metal. In all of these processes, the geometry of the casting, that is, the number of patterns that can be arranged around the riser, is limited by the necessity of leaving sufficient space around the riser to facilitate the separation of the castings from the riser. U.S. Pat. No. 4,112,997 proposes the inclusion of "stabilizing" screens in the gates. It is claimed that the screens will retain alloy in the mold cavities after pressure in the mold chamber is returned to ambient. If indeed practical and economical, this process would remove the geometric constraint imposed by the cutting of the castings from the solidified riser, by eliminating the riser itself.

An object of the present invention is to provide a centrifugal countergravity casting method and apparatus that overcomes the above described problems and compromises associated with filling of mold cavities at different elevations along the length of the riser passage.

Another object of the invention is to provide a casting method and apparatus for trapping molten metal or alloy in the mold cavities and gates through centrifugal action, while allowing for the voiding of the molten metal from the riser, resulting in castings unattached to the riser.

SUMMARY OF THE INVENTION

The present invention provides in one embodiment method and apparatus for countergravity casting a plurality of articles wherein a ceramic mold is provided having an upstanding riser passage and a plurality of mold cavities disposed along a length of the riser passage at different elevations, each mold cavity communicating to the riser passage via a gate passage, wherein molten metal is caused to flow upwardly from a source into the riser passage for supply to the mold cavities via their gate passages, wherein the mold is rotated so that molten metal that resides in the gate passages is subjected to centrifugal force in a direction toward the mold cavities, and wherein molten metal in the riser passage is drained to empty the riser passage before molten metal in the mold cavities and the gate passages completely solidifies, leaving the gate passages at least partially filled with molten metal for supply to the mold cavities in response to shrinkage as molten metal therein solidifies while the container is rotated. The molten metal in the mold cavities is solidified while rotating the container to form a plurality of individual solidified cast articles in the mold cavities. Rotation of the mold can be terminated after molten metal solidifies in the mold cavities. Much higher yields of metal or alloy of 80% and above are achievable by practice of the invention. A much greater number and larger size of articles with increased density due to reduced shrinkage can be cast in practice of the invention.

When the riser passage is drained, ambient pressure is present therein such that still molten metal partially filling the gate passages and filling the mold cavities is subjected to ambient pressure plus pressure due to centrifugal motion of the container in a manner that increases density of cast articles by reducing shrinkage. The molten metal residing in the gate passages solidifies faster once the riser passage is drained to reduce or prevent flow back of molten metal from the gate passages.

In a preferred embodiment of the invention, the steps of causing the molten metal to flow upwardly into the riser passage and of rotating the mold are conducted concurrently during filling of the mold cavities when casting molten metals that are prone to shrinkage problems. These steps optionally can be conducted sequentially with mold rotation being initiated after the molten metal is caused to flow upwardly to fill the mold cavities. The mold can be rotated about a longitudinal axis of the mold or an axis offset from and substantially parallel to a longitudinal axis of the mold.

In another embodiment of the invention, each mold cavity is elongated in the direction of the riser passage and is positioned (e.g. tilted) relative to the riser passage such that a theoretical melt surface provided by mold rotation passes only through the gate passages during draining of the riser passage but does not pass through the mold cavities so that molten metal is not voided from the mold cavities as the riser passage is drained.

In another embodiment of the invention, each mold cavity is elongated in the direction of the riser passage and is connected thereto by a plurality of gate passages at different elevations on the riser passage. Molten metal is initially solidified at regions in the mold cavity between the gate passages so to confine still molten metal in a plurality of more or less discrete compartments in the mold cavity between the solidified regions such that the gate passages partially filled with molten metal will supply still molten metal therein to a respective compartment in response to shrinkage as molten metal solidifies while the container is rotated.

The invention can be practiced using gas permeable molds and gas impermeable molds. The invention is further beneficial in casting gas impermeable molds to reduce or eliminate entrapped gas in the mold cavities thereof.

In a particular apparatus embodiment of the invention, the ceramic mold is supported in a particulate medium, such as for example dry foundry sand, in an evacuable container. The container is evacuated to subambient pressure to force molten metal upwardly into the mold riser passage and rotated by a rotary drive mechanism disposed on a support frame on which the container is mounted for rotation.

The present invention envisions in still another embodiment of the invention replacing the ceramic mold with a fugitive pattern in the container. The fugitive pattern is supported in a particulate medium in the container and includes an upstanding riser passage-forming portion and a plurality of mold cavity-forming portions disposed along a length of the riser passage-forming portion at different elevations. Each mold cavity-forming portion communicates to the riser passage-forming portion via a gate passage-forming portion. The molten metal progressively destroys the pattern to form a riser passage, mold cavities and gate passages in the particulate medium.

The invention achieves more uniform time of filling of the mold cavities at all elevations as well as more uniform pressure in the mold cavities and reduction of pressure surge proximate the upper mold cavities, reducing gas entrapment in the cast articles.

Advantages and objects of the present invention will be better understood from the following detailed description of the invention taken with the following drawings.

DESCRIPTION OF THE INVENTION

The present invention provides a method and apparatus for centrifugal countergravity casting of a wide variety of components of different types and shapes using a wide variety of metals and alloys where the terminology "metal" as used hereabove and hereafter is intended to include metals and alloys. Typical components that can be made by centrifugal countergravity casting include for purposes of illustration, and not limitation, vehicle (e.g. automotive) internal combustion engine pistons, rocker arms, seat belt components, pre-combustion chambers; gas turbine engine nozzles and turbine blades; missile nose cones, fins, canards, fin actuators, gun components, golf clubs, hand tool components, medical implants, and myriad other components. Such metals and alloys include, but are not limited to,. iron, steel, stainless steel, aluminum, nickel alloys and others. The invention is useful for centrifugal countergravity casting of small and large investment castings alike with identical casting apparatus except for the ceramic shell molds used, rapid casting cycle times, high loading of mold cavities along the riser passage, and high utilization of the metal being cast.

Figures 1, 1C:
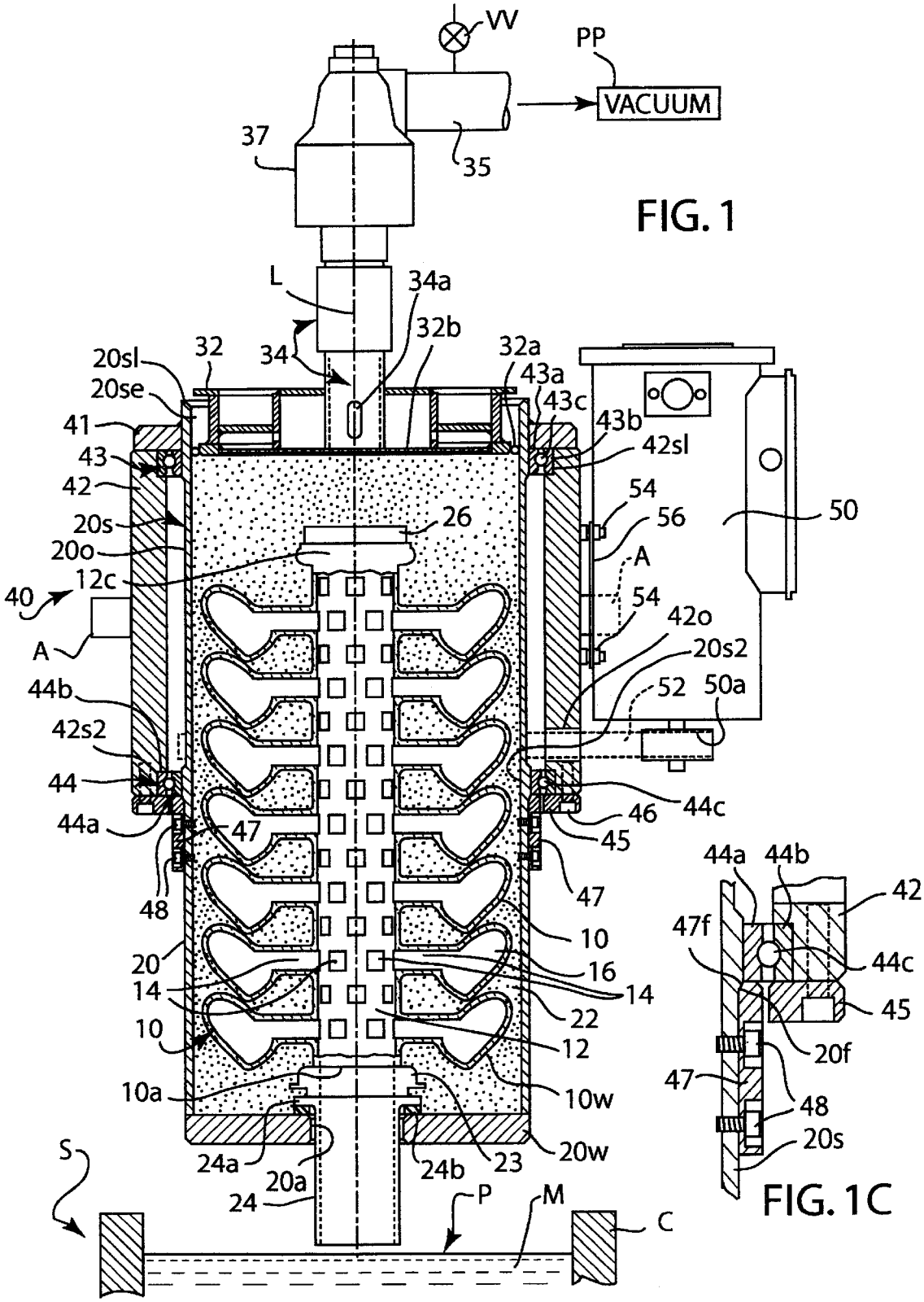
FIG. 1 is a sectioned side elevation of apparatus pursuant to an embodiment of the invention for centrifugal countergravity casting before casting of molten metal into a ceramic shell mold.
FIG. 1C is an enlarged sectional view of the container bearing and cresent assembly.
Figure 2:
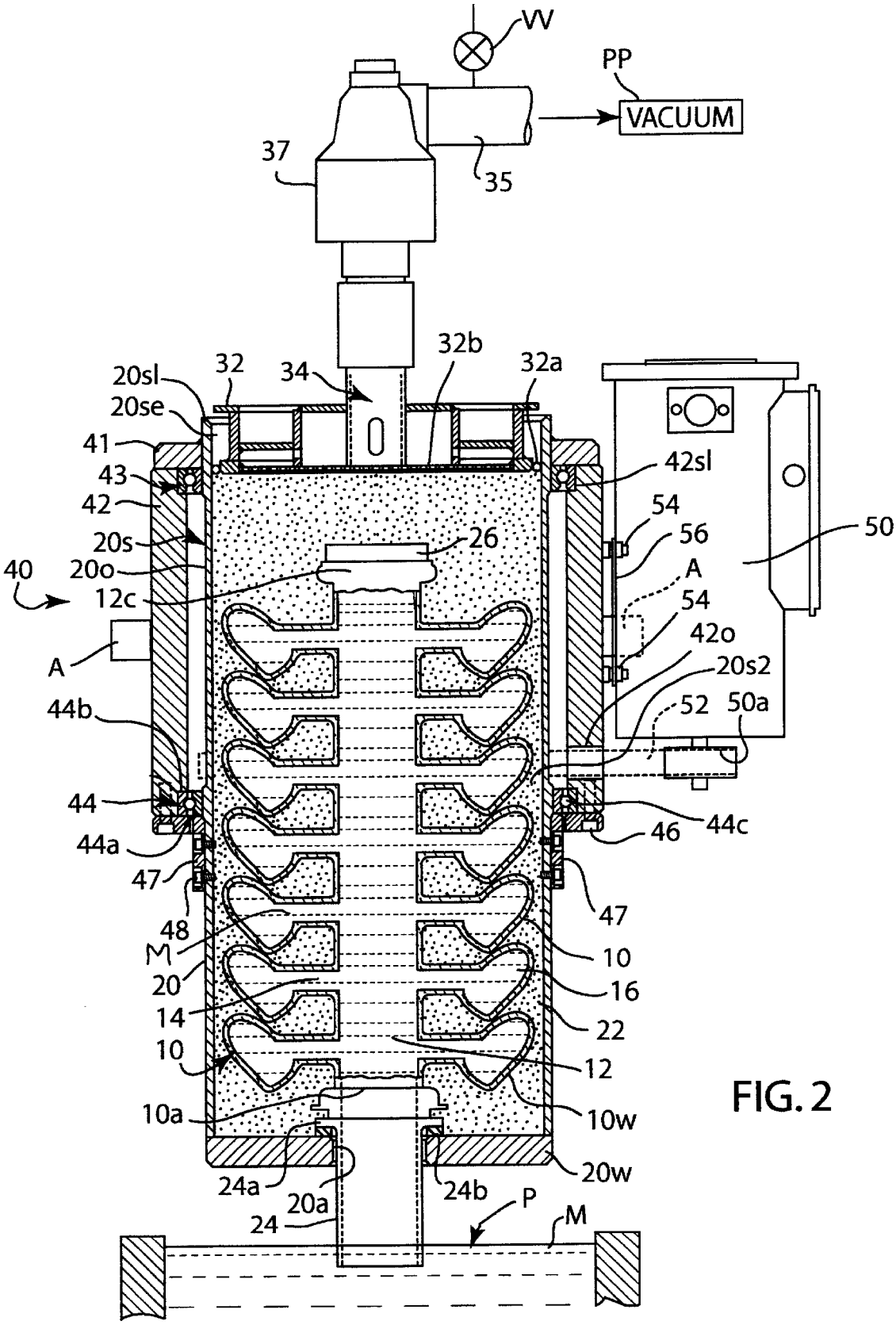
FIG. 2 is a sectioned side elevation of the apparatus of FIG. 1 after casting of molten metal into the shell mold and before draining of the riser passage.
Figure 3:
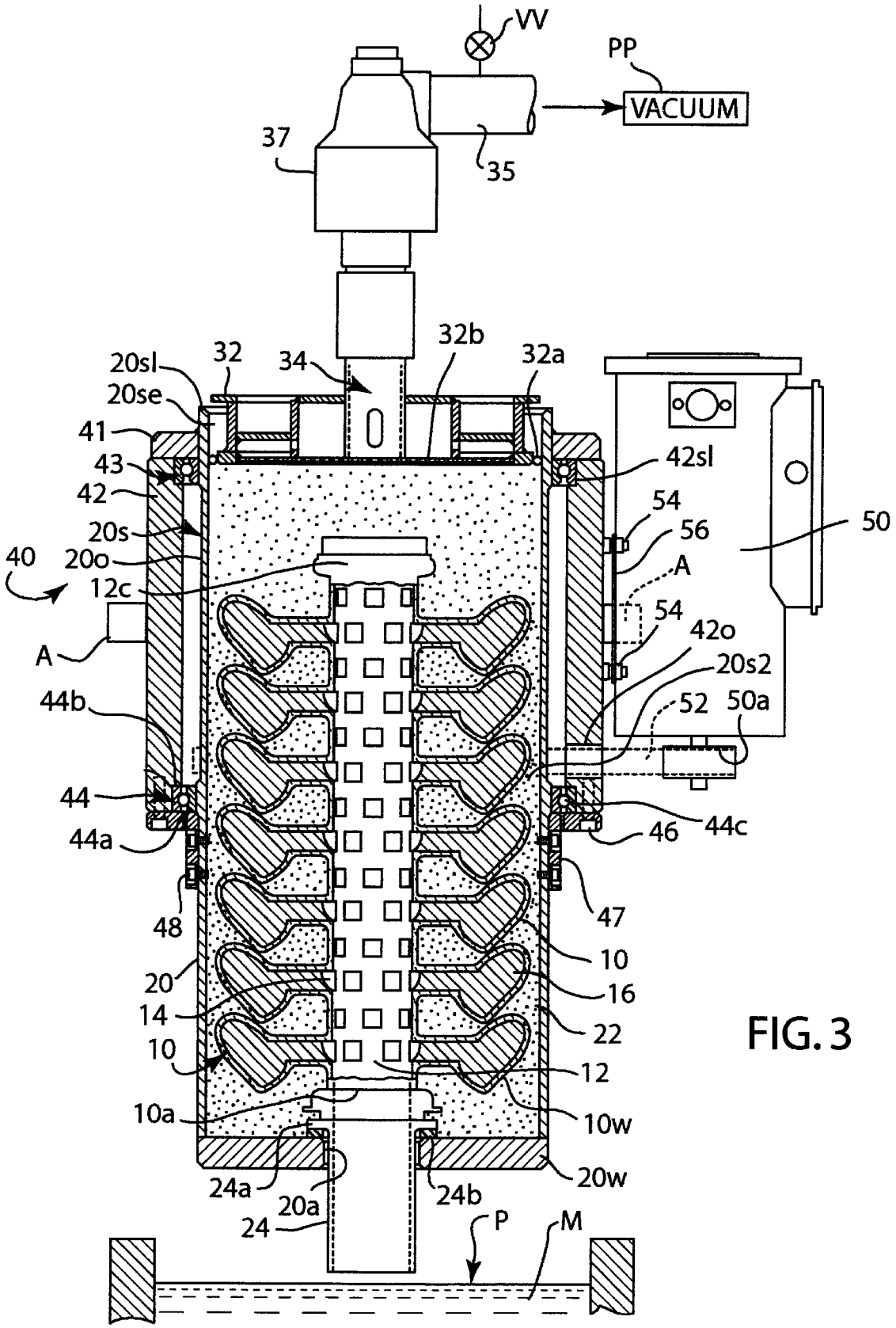
FIG. 3 is a sectioned side elevation of the apparatus of FIG. 1 after molten metal is drained from the riser passage.

Referring to FIGS. 1–3, a gas permeable ceramic shell mold 10 is formed pursuant to the well known lost wax process where a fugitive (e.g. wax) pattern assembly (not shown) of the mold 10 is dipped in ceramic slurry (e.g. a suspension of refractory powder such as zircon, alumina, fused silica and others in a liquid binder such as ethyl silicate or colloidal silica sol), excess slurry is drained from the pattern assembly, and the slurry coated pattern assembly is sanded or stuccoed with dry coarser refractory particles (e.g. granular zircon, fused silica, mullite, fused alumina and others), and then. air dried in repeated fashion to build up the shell mold 10 on the pattern assembly. The pattern assembly then is removed by thermal (e.g. only steam autoclaving) or other suitable pattern removal means to leave the shell mold, which is then fired at elevated temperature depending upon the refractory constituents used in its manufacture to develop mold strength for casting. U.S. Pat. No. 5,069,271 describes the lost wax process for making a thin-walled ceramic shell mold on a pattern assembly for use in practicing the invention, the teachings of which are incorporated herein by reference. The resulting shell mold 10 has porous, gas permeable mold walls 10*w*.

The ceramic shell mold 10 includes an upstanding riser passage 12 communicated by a respective lateral gate passage 14 to a respective mold cavity 16 having the shape of the component to be cast. In practicing the invention, a plurality of individual mold cavities 16 can be spaced apart about the periphery (e.g. circumference) of the riser passage 12 at different elevations (.i.e. different axial locations) along the length of the riser passage 12 as illustrated in FIGS. 1–3. For example, in FIG. 1, eight gate passages 14 are provided to supply molten metal to eight mold cavities 16 spaced apart about the circumference of the riser passage at each elevation (axial location) along the length of the riser passage 12. A total of 112 mold cavities 16 are thereby provided in the mold 10.

Figure 3A:
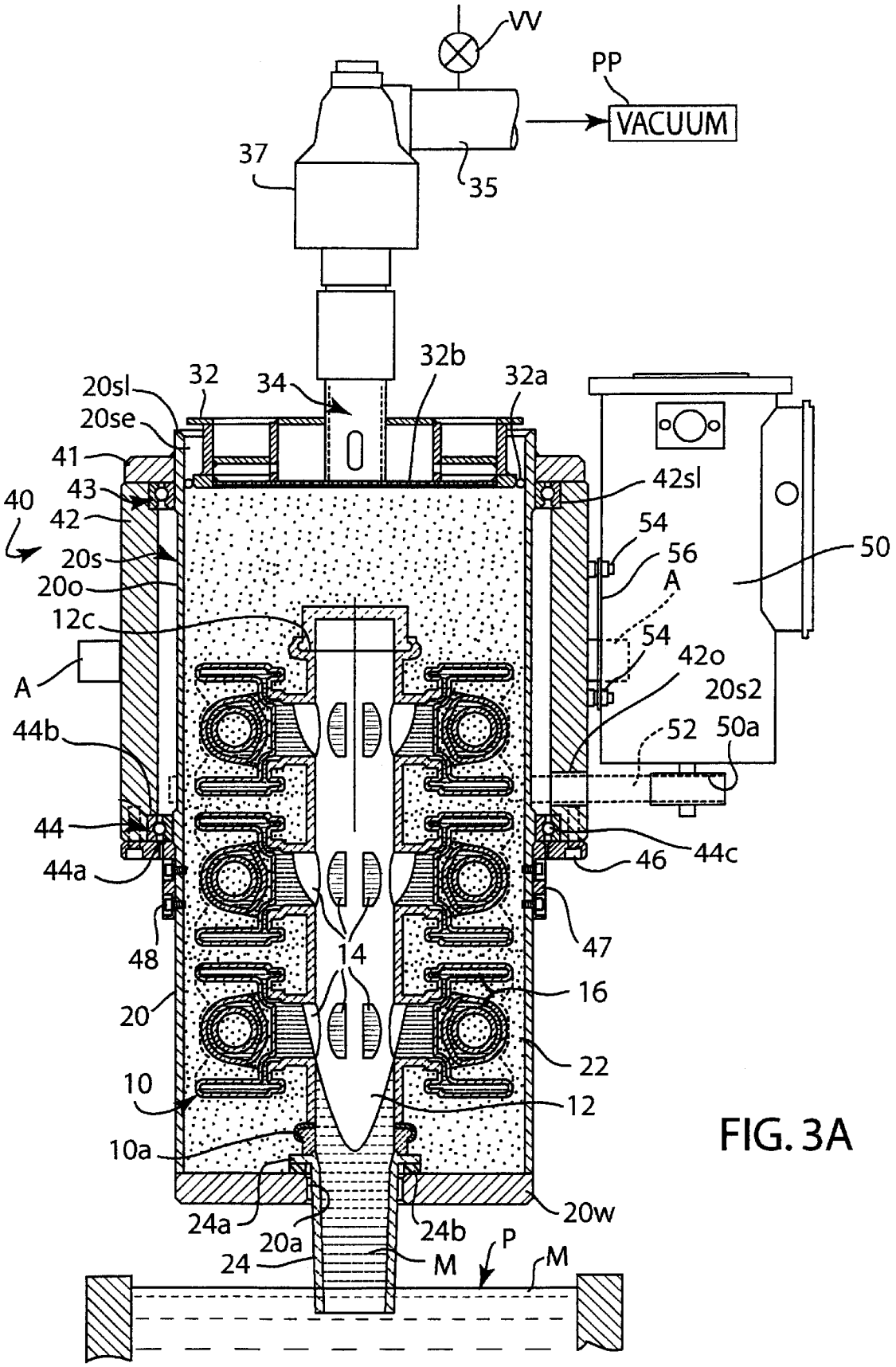
FIG. 3A is a sectioned side elevation of the apparatus of FIG. 1 with a different mold having piston-shaped mold cavities as molten metal is draining from the riser passage and just passing the bottom gate passages of the mold.

Typically, 6 to 12 mold cavities are located at each level when making smaller castings. For casting much larger castings such as automotive pistons, FIG. 3A, where like features are designated by like reference numerals, 3 to 4 mold cavities 16 can be provided at a given mold elevation in 3 to 5 rows along the elevation of the mold 10. In this embodiment, the gate passages 14 are normally much wider than those shown in FIGS. 1–3. The wide gate passages 14 are needed to supply sufficient feed metal during the solidification process. Gate passages 14 that are 1 inch by 2 inches are not unusual; for example, see FIG. 3A.

Alternatively, an annular mold cavity (not shown) can be disposed about the periphery of the riser passage 12 at different elevations along the length of the riser passage with each annular mold cavity communicated to the riser passage 12 by one or more gate passages. For example, an annular mold cavity having the shape of a gas turbine nozzle ring can be disposed at different axial locations along the length of the riser passage so that a plurality of nozzle rings can be cast in the mold 10.

Pursuant to an embodiment of the invention, the ceramic shell mold 10 is positioned in a rotatable metal (e.g. only steel) vacuum flask or container 20. The open lower end 10*a* of the mold 10 is placed on a sealing collar 23 that in turn is placed on a sealing collar 24*a* of an upstanding tubular fill tube 24 that extends outside the container via opening 20*a* in bottom wall 20*w* thereof. Thermoplastic glue or a ceramic fiber gasket can be placed between the lower end 10*a* and collar 24*a,* although the lower end 10*a* can rest directly on collar 24*a* with molten metal solidifying in any gap to provide an in-situ seal therebetween. The collar 24*a* includes annular seal gasket 24*b* on the underside thereof that faces the bottom wall 20*w* of the container. The fill tube typically comprises a ceramic material (e.g. mullite material when casting ferrous materials), although the fill tube can comprise any other material compatible with the molten metal being cast. A porous gas permeable refractory cap 26 is placed and optionally adhered by thermoplastic adhesive on the upper open end 12*c* of the riser passage 12 to close off the upper end. A gas-impervious cap or plug also can be used to close off the open end 12*c*.

In a preferred embodiment of the invention, the mold 10 is surrounded and supported in rotatable vacuum container 20 by a refractory particulate support medium 22 (e.g. dry free-flowing foundry media such as lake bottom sand). The particulate medium 22 typically is introduced into the container 20 about the shell mold 10 through open upper container end 20*se* while the container is vibrated to aid in settling and compacting the particulates about the mold. A movable top vacuum bell or head 32 then is placed in open container end 20*se*. The vacuum head 32 includes an annular air-inflatable seal 32*a* that seals in air-tight manner against the upstanding side wall 20*s* of the container. A perforated plate or screen 32*b* of the vacuum head 32 faces the particulate medium 22. The vacuum head 32 is connected to a vacuum conduit 34 having a conventional rotary vacuum union or coupling 37 that permits conduit 34 and the container 20 to be rotated relative to conduit 35 while evacuating the interior of the container 20. A rotary coupling 37 useful in practicing the invention is commercially available as a 2 inch rotary vacuum coupling from Deublin Company, Waukegan, Ill. The interior of the container 20 is evacuated to subambient pressure by a vacuum pump PP connected to nonrotating conduit 35 that communicates to conduit 34 via coupling 37. The conduit 34 includes one or more openings 34*a* that communicate the vacuum pump PP to the interior of the vacuum head 32, which communicates to the interior of the container 20 via the perforated plate or screen 32*b*. When a partial vacuum (subambient pressure) is established in the container 20, the vacuum bell or head 32 moves axially relative to the container to compress the particulate medium 22 about the mold 10 as described in above-incorporated U.S. Pat. No. 5,069,271. When a vacuum (subambient pressure) is established in the container 20, the riser passage 12, gate passages 14 and mold cavities 16 are evacuated to subambient pressure by virtue of the gas permeability of the particulate medium 22, mold wall 10*w,* and end cap 26.

In an embodiment of the invention, the container 20 is rotatably disposed on a frame 40. The frame 40 comprises an upper annular frame collar or flange member 41 welded to the upper end of wall 20*s* of container 20. Flange member 41 supports the weight of the container and its contents and transmits the load to a cylindrical frame shell member 42 via a conventional upper anti-friction angular contact bearing 43 that is disposed on a recessed shoulder 42*s*1 of tubular shell member 42. The shell member 42 is adapted to be grabbed on the outside by robotic jaws A. Bearing 43 comprises an inner race 43*a,* outer race 43*b* and multiple balls 43*c* therebetween. A conventional lower anti-friction bearing 44 is disposed and held in position in an annular lower recessed shoulder 42*s*2 of tubular frame member 42 between frame member 42 and a lower annular frame collar member 45 affixed by fasteners 46 to the frame member 42. Bearing 44 comprises an inner race 44*a,* outer race 44*b* and multiple balls 44*c* therebetween, FIG. 1C. The frame members 41, 42, 45 are connected to the container 20 to form an assembly or cartridge for use in a casting machine having a robotic manipulator with gripper jaws A.

The container 20 is received in the tubular frame member 42 with the inner races 43*a,* 44*a* of anti-friction bearings 43, 44 rotatably supporting the container 20 so that the container 20 can be rotated about an axis (vertical axis L in FIG. 1) corresponding generally to the central longitudinal axis of the riser passage 12. The container 20 includes a thicker upper. wall region 20*s*1 and lower wall region 20*s*2 received and engaging the inner race 43*a* and 44*a* of the anti-friction bearings 43, 44, respectively. Three conventional circumferentially spaced apart crescents 47 each with a slotted mounting hole are bolted by bolts 48 to the side of container 20*s*. The cresents each include a tapered surface 47*f* that engages a complementary tapered surface 20*f* of the container wall, FIG. 1C. The crescents function to take out play between angular contact bearings 43, 44. The crescents 47 also support the weight of the container 20*s* when the cartridge is inverted upside-down.

The container is rotated on frame 40 by a motor 50 having a drive sprocket 50*a* that drives a belt 52 extending about and frictionally drivingly engaging the outer surface 20*o* of the container wall 20*s*. The belt 52 extends through a slot 42*o* in shell member 42. The motor 50 can comprise a variable speed DC motor, although any type of electrical, fluid or other drive motor can be used in practicing the invention. A 1 HP (horsepower) variable speed DC motor available as model T56S2013 from Reliance Electric Company can be used to practice the invention. The motor 50 is fastened on frame member 42 by fasteners 54 and mounting plate 56. The belt 52 can comprise a 1 inch wide, ½ inch pitch, 114 teeth timing belt model 570H100 available from Gates Rubber Company that is driven by a Dodge 16H100TLA timing pulley available from Daimler Chrysler Corporation and that frictionally engages the container outer surface such that rotation of the belt by sprocket 50*a* rotates the container 20 and its contents.

The frame 40 is gripped and moved by robotic gripper arms A of a casting machine (not shown). In particular, the gripping arms A engage the middle of tubular frame shell member 42. The invention is not limited to such gripper arms as other devices, such as robotic motion devices, or manual movement by a worker can be used to move the frame 40 and container 20 thereon. For example, the arms A alternately may be part of a casting machine of the type disclosed in U.S. Pat. No. 4,874,029, the teachings of which are incorporated herein by reference.

Figure 1A:
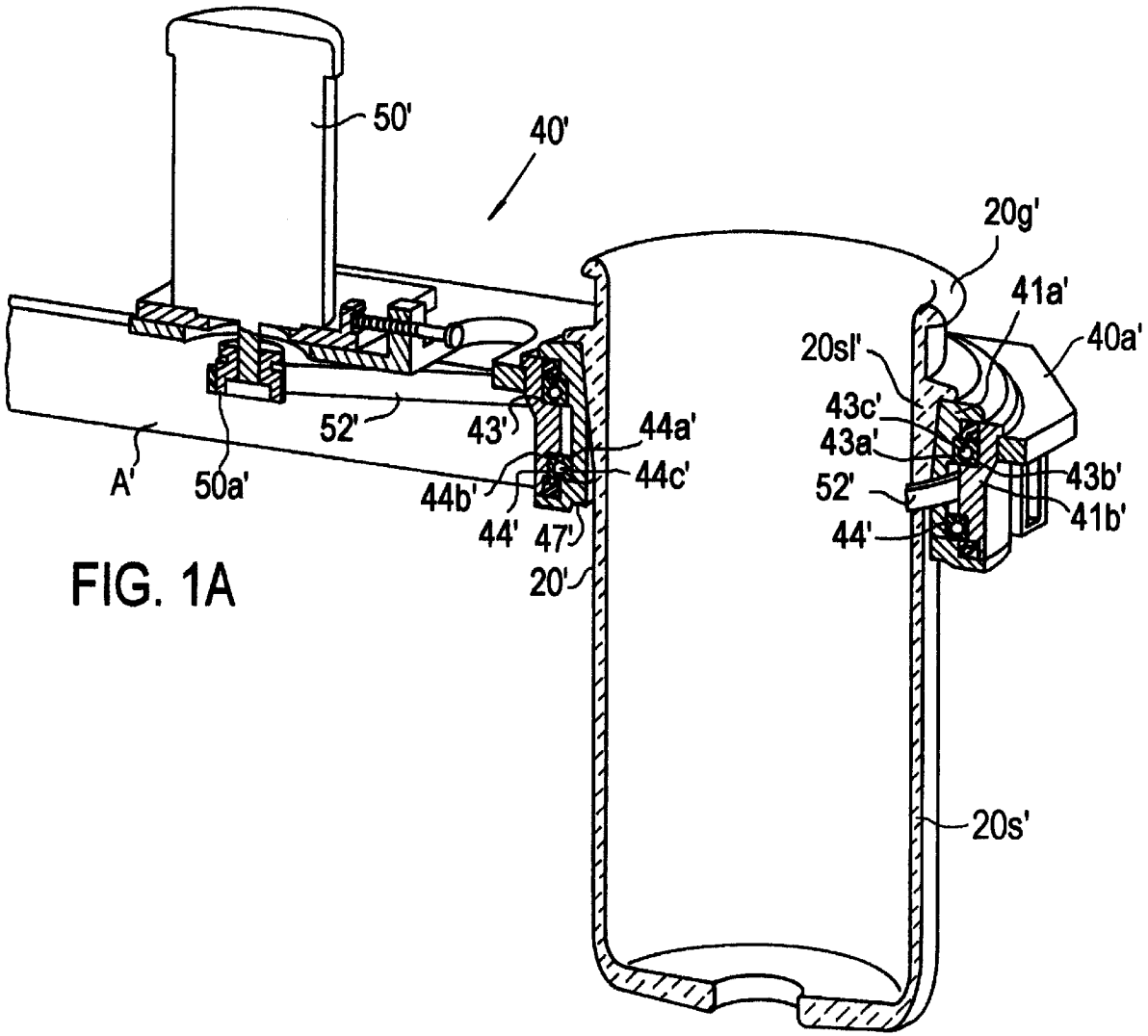
FIGS. 1A and 1B are perspective views of apparatus pursuant to another embodiment of the invention.
Figure 1B:
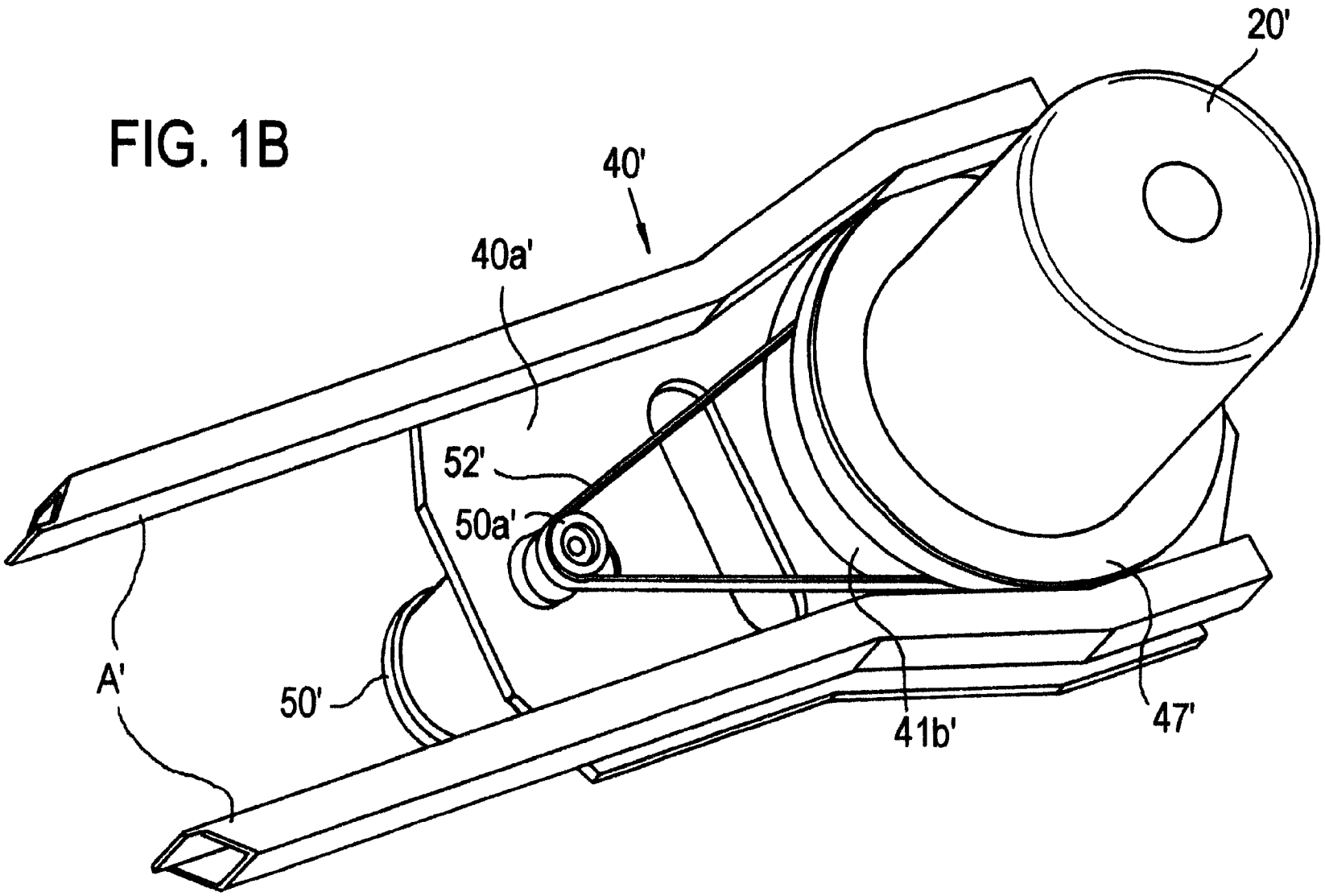

Moreover, the invention is not limited to the particular container 20 and frame 40 shown and described. For example only, referring to FIGS. 1A and 1B where like reference numerals are used to designate like features of FIGS. 1–3, a vacuum container 20' and frame 40' are shown having a somewhat different configuration. The container 20' includes an outwardly tapering wall region 20*s*1' on upstanding wall 20*s*' and terminating in a radially extending upper shoulder 20*g*'. Anti-friction bearings 43', 44' are disposed between inner ring 41*a*' and an outer ring 41*b*'. Each bearing 43' and 44' includes inner race 43*a*', 44*a*' and outer race 43*b*', 44*b*' with balls 43*c*' 44*c*'. A lower annular retainer 47' is fastened on the ring 41*a*' to support the bearing 44'. Outer ring 41*b*' is fixedly mounted (e.g. welded) on an elongated support frame member 40*a*' which is affixed (e.g. welded) to arm A'. Inner ring 41*a*' is supported by the bearings 43', 44' and caused to rotate by timing belt 52'. An electric or other motor 50' is mounted on the elongated frame 40' and includes a drive sprocket 50*a*' that drives a belt 52' frictionally engaging inner ring 41*a*' so as to rotate the container 20', FIG. 1A. For example, when inner ring 41*a*' is rotated, container 20' is caused to rotate by friction with the inner ring. The frame 40' is shown supported for movement by arms A' of a casting machine. The arms A' are fixed relative to one another and engage the underside of frame member 40*a*', FIG. 1B. The container 20' and frame 40' can be used in lieu of container 20 and frame 40 of FIGS. 1–3 in practicing of the invention as described above. The container 20' would receive a shell mold 10, particulate medium 22 about the mold, and vacuum head 32 in the manner described above but not shown in FIGS. 1A and 1B for convenience.

The container 20 (or 20') is moved from a loading station (not shown) where the mold 10, particulate medium 22, and vacuum head 32 are assembled therein and then to a casting position, FIG. 1, where the container 20 (20') is positioned by arms A (A') of the casting machine above a source S of molten metal to be cast into the mold 10. The source S is illustrated as comprising a molten metallic pool P (e.g. molten metal or alloy) contained in a crucible C and heated by induction coils (not shown) about the crucible as shown for example in U.S. Pat. No. 3,863,706, the teachings of which are incorporated herein by reference.

Pursuant to an embodiment of the invention, at the casting position of FIG. 1, the container 20 is rotated by actuation of motor 50 before or after the fill tube 24 is immersed in the pool P. For example, one illustrative motion sequence involves rotating the container 20 above pool P, then immersing the fill tube 24 in pool P. and then evacuating the container 20 to provide subambient pressure therein by actuation of vacuum pump PP. Another illustrative sequence involves immersing the fill tube 24 in pool P and then evacuating the container 20 to subambient pressure followed by rotation of the container. Other sequences can be employed. Subambient pressure in the container can be in the range of 13 inches Hg to 18 inches Hg for practicing the invention to force up to 150 pounds or more of molten metal or alloy to flow upwardly into the mold 10, although the invention is not so limited as other vacuum levels in the container 20, and/or increasing pressure over the molten metal surface of pool P to provide superambient pressure on pool P with or without subambient pressure in container 20, can be used depending upon the countergravity casting parameters employed, mold configuration employed, and molten metal or alloy being cast. Rotational speeds of the container will depend in part on the size (e.g. diameter) of the riser passage 12 and can be in the range of 150 to 300 rpm. For purposes of illustration and not limitation, a rotational speed of 300 rpm can be used with a riser passage 12 having a diameter of 3 inches. A rotational speed of 150–200 rpm can be used with a riser passage 12 having a diameter of 5 inches. The invention is not limited to any particular rotational speed which can be selected depending upon the countergravity casting parameters employed, mold configuration employed including size of the riser passage, and molten metal being cast. The metallostatic head created by the centrifugal action is independent of the alloy composition. For example, the free surface of liquid aluminum created by rotation will be the same as the free surface of liquid steel at the same mold rpm. Because of steel's greater density, the centrifugal pressure will be higher for steel, yet the metallostatic head will be the same as that of liquid aluminum.

Pursuant to the first motion sequence described above, the rotating container 20 (20') and underlying source S of molten metal or alloy M are relatively moved to immerse the open end of fill tube 24 in the molten metal M to fill the mold 10 with molten metal or alloy M. Typically, the container 20 (20') is lowered by the arms A (A') to immerse the fill tube 24 in stationary pool P, although the crucible C also can be moved alone or together with the container 20 (20') to this end. The subambient pressure in the container 20 is then provided and is sufficient to generate a differential pressure (e.g. ambient pressure on the pool P and subambient pressure in the container and thus in the mold 10) effective to force the molten metal to flow from the pool P upwardly into the riser passage 12, through the gate passages 14 into the mold cavities 16 to fill same with molten metal while the container is concuurently rotated, FIG. 2.

The molten metal that resides in each gate passage 14 is subjected to centrifugal force in a direction toward the mold container 20 and mold 10 retards solidification of the molten metal in the riser passage 12 and retards fusion of the individual castings in the mold cavities 16 to the riser metal. The rotational motion creates shear forces in the molten metal at the gate passages 14 and generates a mild pumping action and movement of the molten metal toward the associated mold cavity 16 to retard skull formation (solidification of the molten metal at the riser passage surfaces) in the riser passage 12. The centrifugal forces acting on the molten metal residing in the riser passage 12, gate passages 14, and mold cavities 16 increase the pressure across the molten metal in all gate passages 14 regardless of their elevation on the riser passage 12, thereby enhancing filling out of the mold cavities 16. This, in turn, enables a reduction of the rate at which the molten metal column rises in the riser passage 12 to delay the time at which the top of the molten column reaches the closed upper end (cap 26) thereof until after most or all mold cavities 16 are filled. The pressure spike across the gates of the top few rows of mold cavities heretofore observed in counter gravity casting of a mold with mold cavities at different elevations on the riser passage can be substantially reduced or eliminated altogether.

For purposes of illustration and not limitation, a representative time to fill the mold cavities 16 is less than 4 seconds and typically about 1½ seconds depending, however, upon the countergravity casting parameters employed, mold configuration employed, and amount of molten metal to be cast into the mold 10.

The rotational motion of the mold creates shear in any liquid metal moving through the riser. This, along with vibration caused by minor imbalances of the rotating mold and machinery, retard solidification of the molten metal in the riser past the point where a skull would start to form if the mold were not rotated. If advantageous to the process, this phenomenon allows retention of the molten metal in the riser for a longer time than in a non-rotating mold, or it allows the casting of metals and alloys at a lower temperature while retaining the advantage of avoiding a solidified riser.

Figure 5:
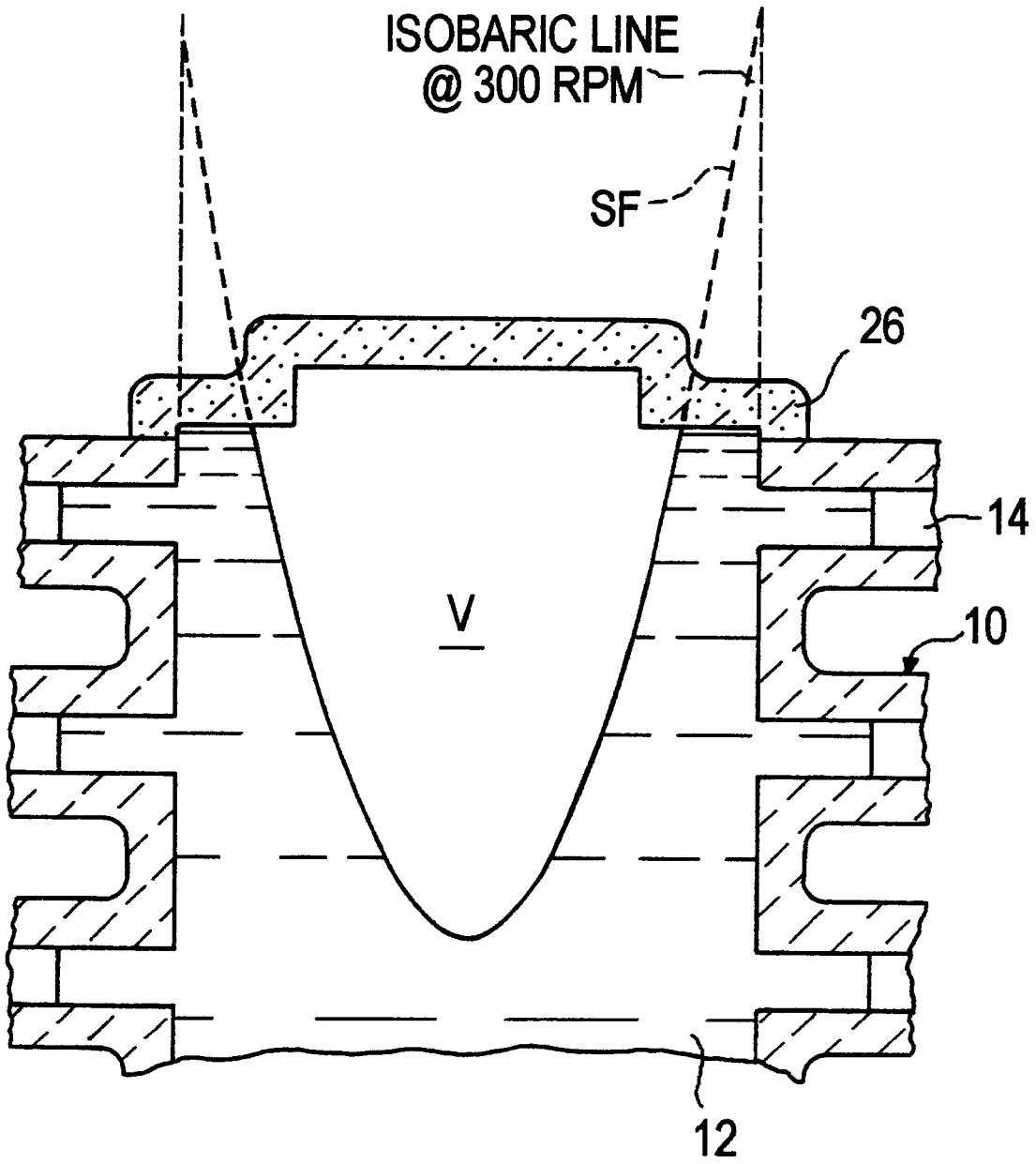
FIG. 5 is an enlarged partial sectional view of an upper end region of a mold riser passage and a porous cap showing the molten metal surface formed as a result of mold rotation acting on the molten metal column under insufficient pressure differential to completely fill the riser passage such that the column is below the porous cap.

Moreover, by proper choice of the vacuum level (subambient pressure) in the container 20 to be a lesser vacuum than is required to fill to the riser cap 26, the molten metal can be caused to flow upwardly in the riser passage 12 to a distance short of (i.e. below) a center region of the upper closed end (cap 26) of the riser passage 12 illustrated in FIG. 5 with somewhat different configurations from those shown in FIGS. 1–3. For example, the molten column proximate the cap 26 forms an interior void V defined by an isobaric surface SF at a given rotational speed and formed generally about the longitudinal axis of the riser passage 12 as a result of rotational motion of the container 20 (20') and mold 10. The presence of interior void V in the upper end of the molten metal column reduces pressure surge across the gate passages 14 proximate the closed upper end (cap 26) of riser passage 12. If void V is not present, as when molten metal completely wets cap 26, the melt in the riser passage 12 creates a pressure surge across the gates 14. The interior void V also provides an escape path or space to which entrapped gas in the molten metal proximate the upper end of the molten column can migrate to reduce entrapment of gas in molten metal filling the upper mold cavities, thereby reducing entrapped gas in the castings solidified in those mold cavities. Centrifugal force causes molten metal to displace entrapped gas in the riser passage 12 toward the middle of the riser passage, where it has much less chance to enter the mold cavities.

Once the mold is filled with molten metal from pool P and while the container 20 (20') and mold 10 are still rotated with the fill tube 24 immersed in the pool, the still molten metal in the riser passage 12 is drained back to pool P before molten metal M in mold cavities 16 and gate passages 12 solidifies. Riser passage 12 is drained by discontinuing the vacuum level in the container by, for example, shutting off vacuum pump PP and opening a vent valve VV in the vacuum piping, FIG. 2, communicated to ambient pressure to provide ambient air pressure in the container. Pressure on the molten column in the riser passage 12 is equalized such that the molten metal in the riser passage 12 flows by gravity back to underlying pool P for reuse. As a result, much higher yields of the metal or alloy of 80% and above are achievable by practice of the invention as compared to prior counter-gravity casting processes where the molten metal in the riser passage 12 is solidified with that in the gate passages and mold cavities. A much greater number and larger size of mold cavities 16 can be located about the riser passage 12 since the cut-off geometry heretofore required to cutoff solidified gates from the solidified riser is not required in practice of the invention. As a result, a much greater number of cast articles can be cast in each mold 10 in practice of the invention.

When the molten metal is drained from the riser passage 12, the gate passages 14 are thereby separated from the now empty riser passage 12. Molten metal is retained in the gate passages 14, at least partially filling them as shown in the left hand side of FIG. 4, by virtue of the centrifugal forces due to rotation of the container 20 (20') and mold 10. The molten metal partially filling the gate passages 14 and completely filling the mold cavities 16 is subjected to the ambient (e.g. atmospheric) pressure in the riser passage 12 plus pressure due to centrifugal forces from rotational motion of the container 20 (20') and mold 10 such that the pressure across the gate passages 14 is generally equal regardless of their elevation along the riser passage 12. For example, at a container rotation of 300 rpm, a pressure in the mold cavities 16 at a distance of 5 inches from the center axis of the empty riser passage 12 has been determined to be 22.7 psi in each mold cavity at all elevations along the length (28 inch length) of the riser passage 12. Thus, feeding pressure is the same across all of the gate passages 14 to improve uniformity of feeding of the mold cavities from top to bottom of the mold 10. At this point, the mold cavities are completely filled. Filling of the mold cavities refers to the flow of molten metal from the riser passage to initially fill the mold cavities. Feeding refers to subsequent supplying of the molten metal from the gate passages 14 to fill voids created by the phase change during solidification and thermal contraction of the metal in mold cavities 16.

Figure 4:
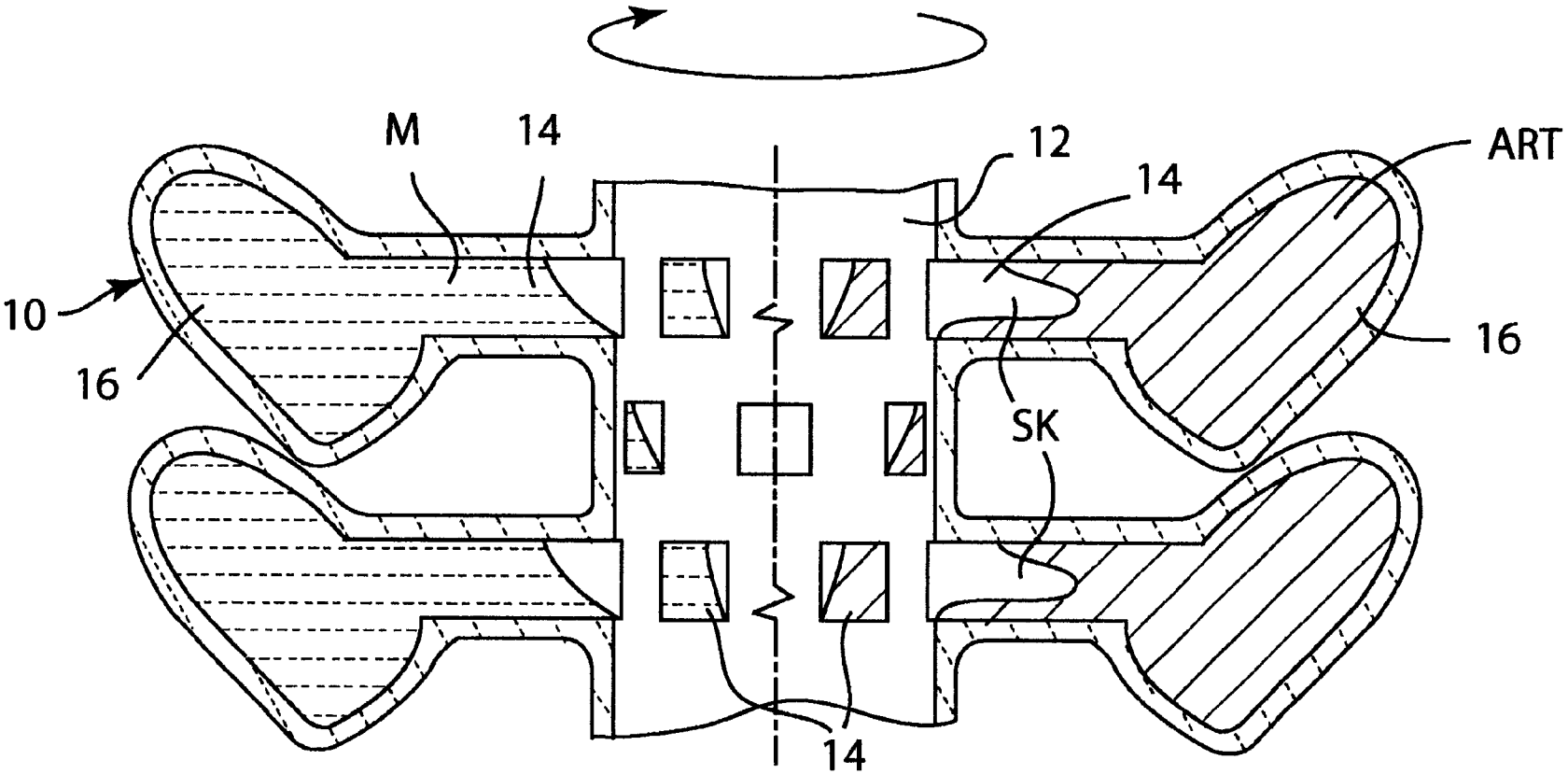
FIG. 4 is an enlarged partial sectional view of the mold riser passage, gate passages, and mold cavities where the left side of FIG. 4 illustrates molten metal in the gate passages and mold cavities immediately after molten metal is voided from the riser and where the right side of FIG. 4 illustrates solidified metal in the gate passages and mold cavities.

That is, the molten metal residing in the gate passages 14 is available for supply to the mold cavities 16 in response to shrinkage as molten metal therein solidifies while the container 20 (20') is rotated as shown in the right hand side of FIG. 4. In particular, as the metal in one or more mold cavities 16 solidifies and undergoes shrinkage while the container is rotated, molten metal from the associated gate passage 14 flows as needed to the mold cavity 16 communicated thereto to counter the shrinkage to produce cast articles ART with improved density (e.g. reduced shrinkage porosity). A shrinkage cavity SK typically is formed in the metal solidified in one or more of the gate passages 14 but not in the cast metal article (casting) ART solidified in the mold cavity as illustrated in the right side of FIG. 4. A plurality of individual, distinct solidified cast articles ART are thereby produced in the mold cavities 16 unconnected to the riser passage 12. FIG. 3 shows the solidified metal in the mold 10 with the skrinkage cavities. SK omitted for convenience. Porosity due to entrapped gas in the cast articles ART also is reduced as a result of the presence of ambient (e.g. atmospheric) pressure plus centrifugal pressure across all of the gate passages 14 by virtue of the pressure reducing the volume of any entrapped gas void in the metal. A much greater number of cast articles ART can be cast in each mold 10 with little or no shrinkage porosity in practice of the invention.

Residence time of the fill tube 24 immersed in the molten pool P is reduced in practice of the invention since with proper gate design, the fill tube needs to be in the pool P for only the time required to fill the mold cavities, after which the molten metal in the riser passage 12 can be voided. Solidification of the castings and of the gate passages can occur after the fill tube is removed from the pool. Practice of the invention also reduces exposure of container 20 to radiant heat from the pool P and induction heating from the furnace induction coils, thereby extending container life. Furthermore, solidification time is reduced in practice of the invention since gate passages 14 freeze off (solidify) faster locally at the junction with the empty riser passage 12 than when hot molten metal resides in the riser passage. Much higher metal yields (metal forming the cast articles ART divided by the metal cast into mold 10) of 90% and above are achievable by practice of the invention. In addition, a much greater number and larger size of cast articles with increase density due to reduced shrinkage can be cast in practice of the invention. As an example, prior to practice of the invention, 26.1 pounds of molten metal were needed to produce 28 castings of a particular kind, and the mold remained in the container 20 for 10 minutes. With practice of the invention, only, 18.9 pounds of the same molten metal were required to obtain 56 of the same type of castings, and the mold 10 was kept in the container 20 for only 3 minutes.

With very expensive alloys, metal yield can be further increased at the expense of a longer casting cycle. The cross-section and the length of the gate passages 14 can be reduced and feeding of the molten metal from the riser passage 12 can be maintained until just before the metal in the riser passage begins to solidify. If at this point, the molten metal is voided from the riser passage 12 and mold rotation is continued for a short time to allow the gate passages 14 to solidify, individual castings with very small gates are obtained. Metal yields of 97% have been attained. using this technique.

After the molten metal solidifies in the mold cavities 16, the vacuum head 32 is removed, and container 20 (20') with the solidified castings (cast articles ART) in the mold 10 can be moved by arms A (A') to a shakeout table (not shown) followed by removal of the particulate medium 22 and cast articles ART for further post-casting processing.

For purposes of illustrating the invention and not limiting it, a shell mold 10 was made having 84 mold cavities (each to hold 1.27 pounds of steel alloy) about a 28 inch tall riser passage 12 with a 5 inch diameter. Each mold cavity was communicated to the riser passage by a single gate passage 14 having dimensions of ½ inch width by ½ inch height by 2 inches length. A ceramic fill tube having a length of 8 inches and diameter of 2.5 inches was connected to the bottom of the riser passage and immersed 4 inches below the surface of pool P of the steel alloy. The container 20 was evacuated to 17 inches Hg and rotated at 150 rpm to fill in the mold cavities in 1.8 seconds with rotation continued for 45 seconds after the riser passage was drained to solidify the metal in the mold cavities.

In the above described embodiment of the invention, the steps of causing the molten metal to flow upwardly from the pool P into the riser passage 12 and of rotating the container 20 (20') are conducted concurrently during filling of mold cavities 16 when casting molten metals that are prone to shrinkage problems during solidification. These steps optionally can be conducted sequentially pursuant to another embodiment of the invention with rotation of the container 20 (20') and mold 10 therein being initiated after the molten metal is forced upwardly into the riser passage 12 to fill the mold cavities 16. This embodiment of the invention reduces turbulence in the molten metal flowing into the mold cavities 16.

Figure 8B:
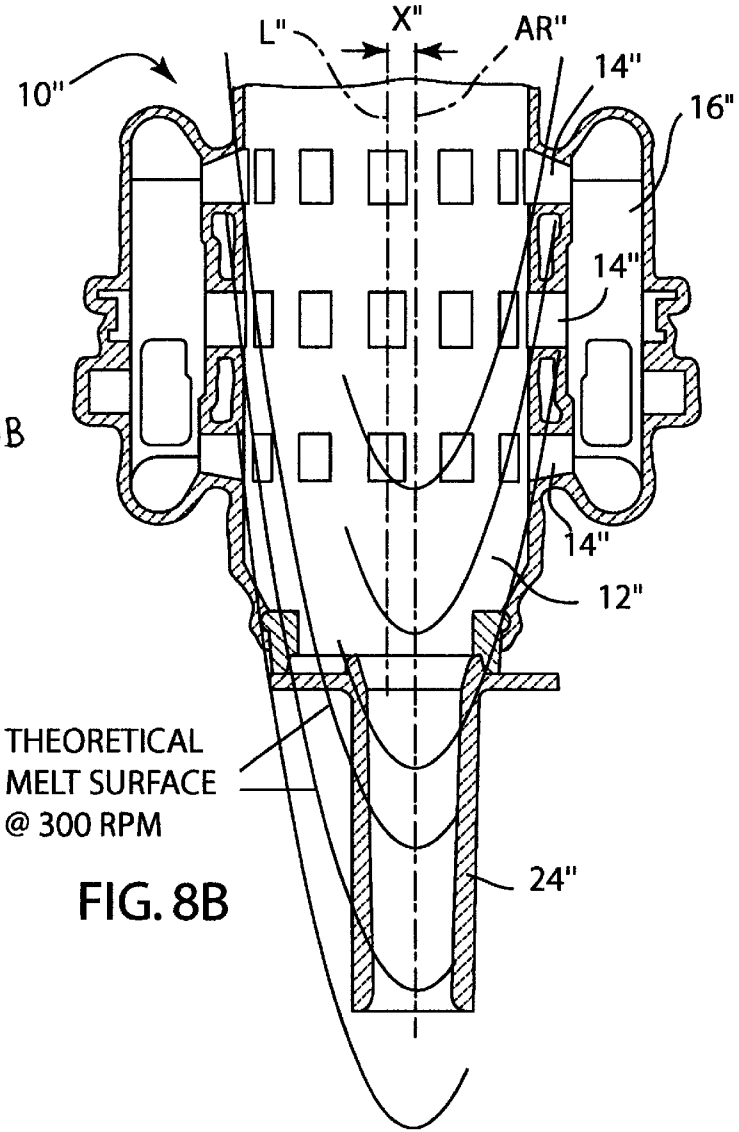
FIG. 8B is a longitudinal cross-sectional view of the mold and fill tube taken along lines 8B–8B of FIG. 8A.
Figure 8A:
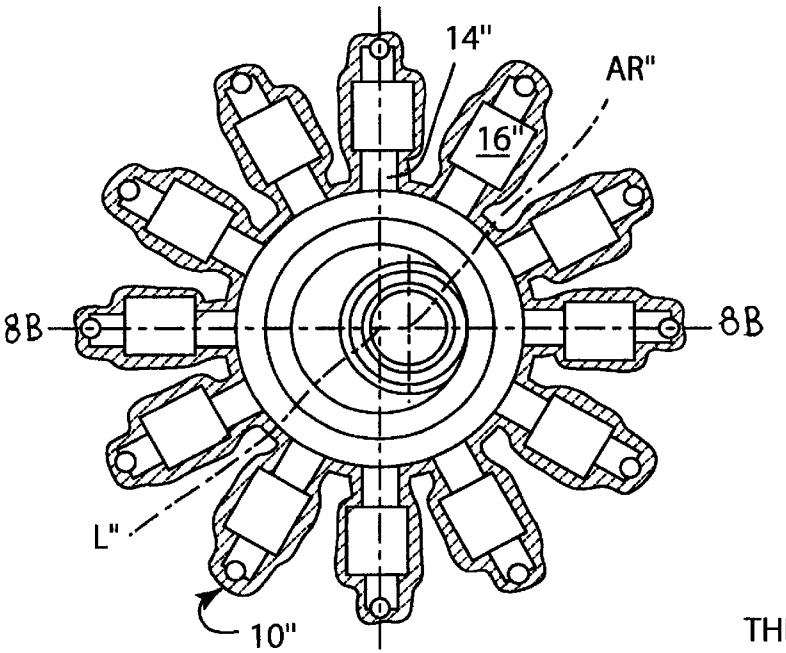
FIG. 8A is a transverse sectional view showing a mold and fill tube arrangement for rotating the mold about an axis offset from the longitudinal axis of the riser passage.

Although the above embodiment involves rotation of the container 20 (20') and mold 10 about a central longitudinal axis L of the riser passage 12 of mold 10 and container 20 (20'), the invention is not so limited since the mold can be rotated about an axis of rotation AR" offset from and substantially parallel to a longitudinal axis L" of the riser passage 12" of the mold 10" as illustrated in FIGS. 8A, 8B where like reference numerals double primed are used to designate like features of previous figures. Axis AR" corresponds to the longitudinal axis of the fill tube 24" and of the container in which the mold is disposed. This can be achieved by mounting the mold 10" in an offset manner in the container such that when the container is rotated, the mold 10" is rotated about axis AR" offset by distance X" from and substantially parallel to a longitudinal axis L" of the riser passage 12" of the mold. Rotation about an offset axis can further delay skull formation in the riser passage 12".

Figure 6:
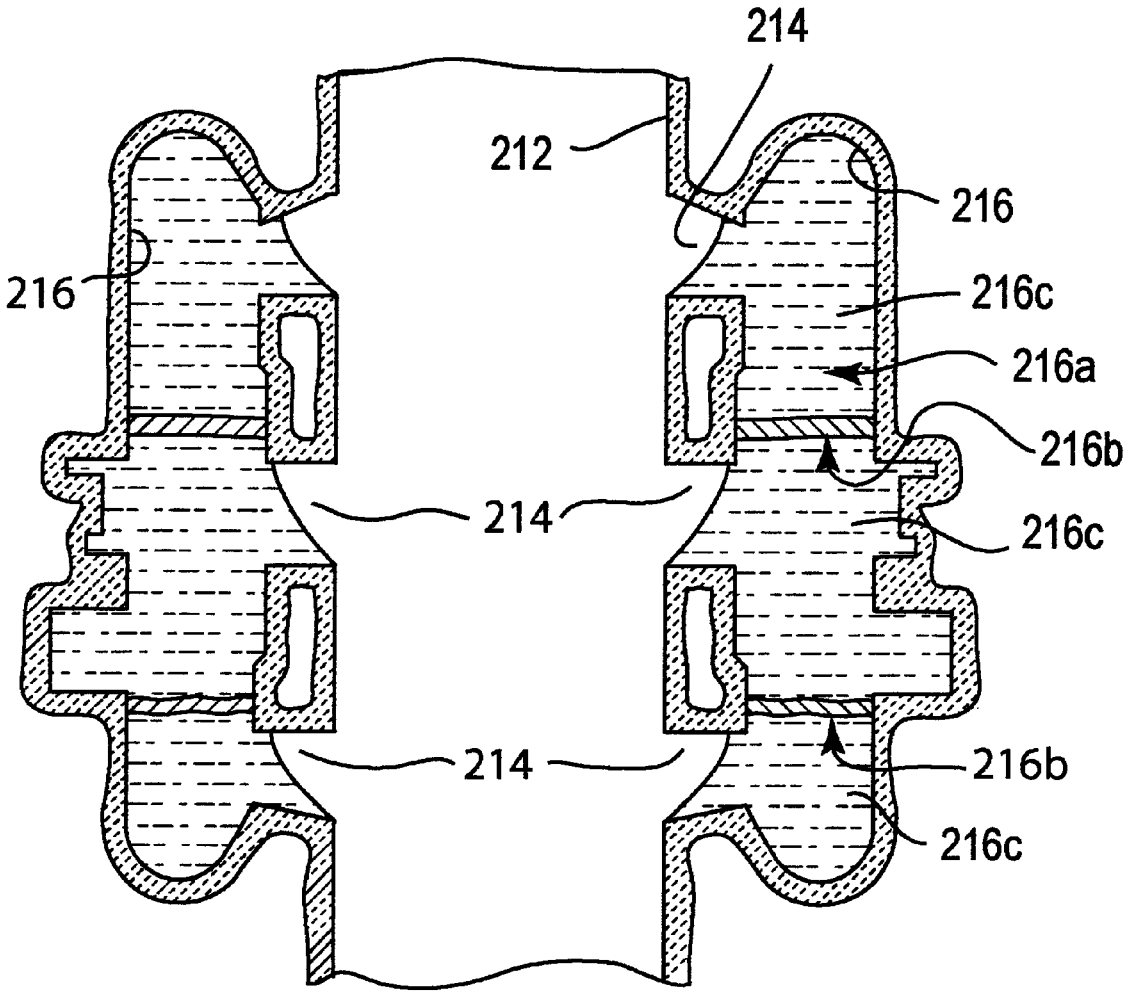
FIG. 6 is an enlarged partial sectional view of the riser passage showing an elongated mold cavity communicated to the riser passage by a plurality of gate passages at different elevations.

Moreover, although the invention has been described above with respect to mold 10 having mold cavities 16 each communicated to riser passage 12 by a singe gate passage 14, the invention is not so limited since each mold cavity can include multiple gate passages. For example, referring to FIG. 6, to produce elongated castings having adjacent relatively thin and thick cross-sectional regions, each of a plurality of mold cavities 216 typically is elongated in the direction of the riser passage 212. Each mold cavity 216 is communicated by a plurality (e.g. three shown) of gate passages 214 at different elevations along the riser passage 212 located to insure feeding of molten metal to the relatively thick regions 216a of each mold cavity. It is possible for the head of molten metal filling elongated mold cavity 216 to overcome the ambient pressure plus centrifugal force after the riser passage 212 is emptied such that molten metal can drain from the lower gate passage 214 to the empty riser passage 212.

This unwanted drainage from elongated one or more of the mold cavities 216 is overcome in practice of another embodiment of the invention by retaining the molten metal in the riser passage 212 long enough while the container 20 (20') and mold 210 are rotated to solidify molten metal in relatively thin regions 216*b* of each mold cavity 216 located between the gate passages 214. When the molten metal then is drained from the riser passage 212 back to pool P as described above, the relatively thin solidified regions 216*b* partition the mold cavity into sub-cavities 216*c* of still molten metal isolated from one another by the thin solidified regions 216*b* such that sub-cavities 216*c* behave as individual single-gated mold cavities so to confine still molten metal in the sub-cavities or compartments 216*c* between the solidified regions 216*b* and prevent flow back out of the lowermost gate passages 214 of the mold cavities 216. The gate passages 214 that are partially filled with molten metal when the riser passage 212 is drained of molten metal will supply. still molten metal therein to a respective sub-cavity or compartment 216*c* in response to shrinkage as molten metal solidifies while the container 20 (20') is rotated as described above.

Figure 7A:
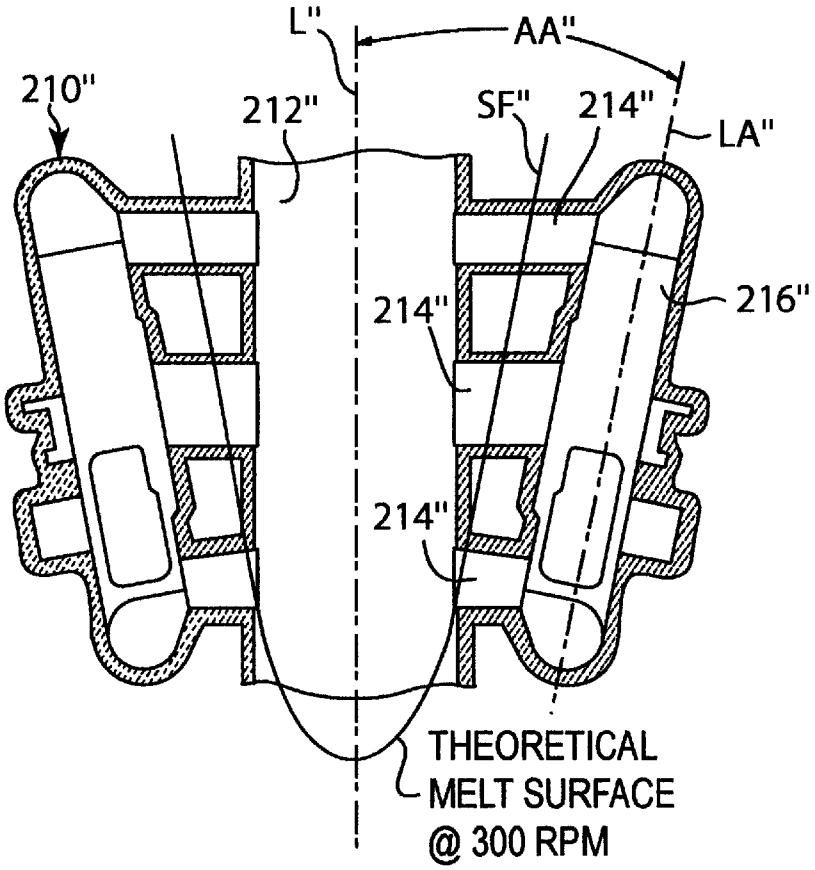
FIG. 7A is an enlarged partial sectional view of the riser passage showing an elongated mold cavity positioned relative to the riser passage that a theoretical melt surface provided by mold rotation passes through a plurality of gate passages at different elevations during draining of the riser passage but does not pass through the mold cavity.

The above unwanted drainage from elongated mold cavities can also be overcome in practice of still another embodiment of the invention as. illustrated in FIG. 7A by positioning the elongated mold cavities 216" of mold 210" relative to the riser passage 212" such that a theoretical melt surface SF" provided by mold rotation passes through the gate passages 214" during draining of the riser passage 212" but does not pass through the mold cavities 216". In FIG. 7A, this positioning is achieved by increasing the length of the gate passages 216" in the direction of increasing elevation along the riser passage 212". For example, with reference to FIG. 7A, the lower gate passages 216" are shown having relatively shorter lengths as compared to those of the intermediate gate passages 214", which have relatively shorter lengths than those of the upper gate passages 214" shown. In effect, the longitudinal axis LA" of each mold cavity 216" is oriented at an outward acute angle AA" relative to the longitudinal axis L" of the riser passage 212" using different lengths of gate passages 214".

Figure 7B:
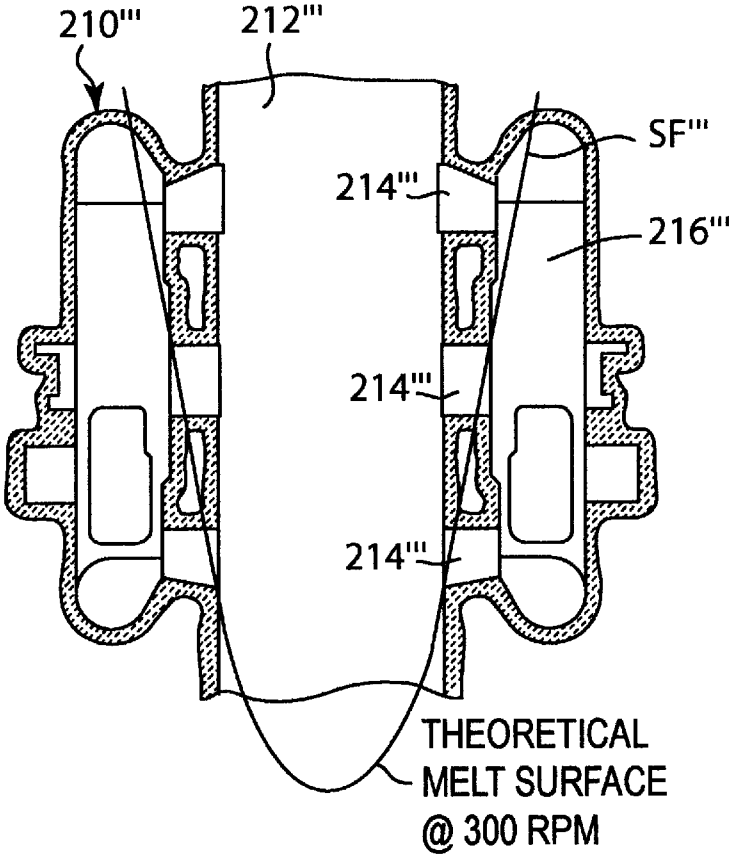
FIG. 7B is an enlarged partial sectional view of the riser passage showing an elongated mold cavity positioned relative to the riser passage that a theoretical melt surface provided by mold rotation passes through a plurality of gate passages at different elevations during draining of the riser passage but does not pass through the mold cavity.

In contrast, FIG. 7B illustrates a similar mold 210" where the mold cavities 216'" are not tilted out pursuant to the invention as shown in FIG. 7A such that if the riser passage 212'" is voided while most of the molten metal in each mold cavity 216'" remains unsolidified, then the theoretical melt surface SF'" provided by mold rotation will pass through the gate passages 214'" and mold cavities 216'" as illustrated during draining of the riser passage. Areas of the mold cavities 216'" where the theoretical melt surface SF'" passes through will void molten metal and produce defective castings. FIG. 7A pursuant to an embodiment of the invention overcomes such unwanted voiding of molten metal from the mold cavities.

Although the invention has been described with respect to embodiments thereof using a gas permeable mold 10 (10", etc.), the invention is not so limited and can be practiced using a gas impermeable mold made, for example, of cast iron, steel, graphite or other material.

Figures 9A, 9B:
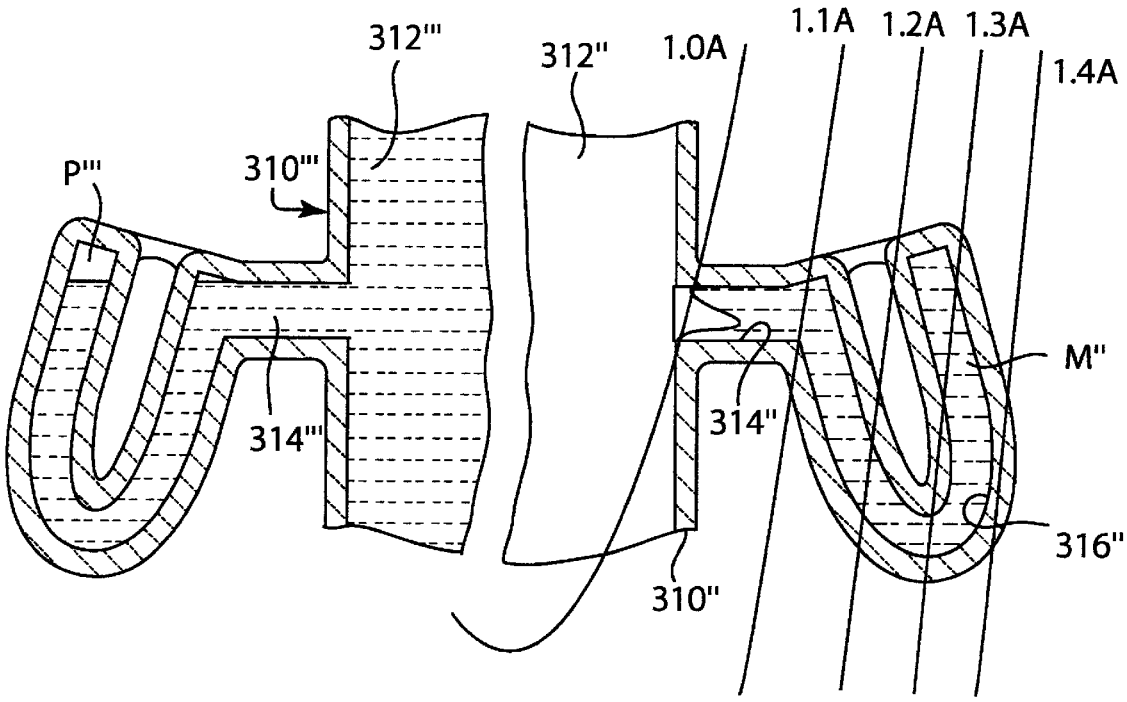
FIG. 9A is a partial sectioned side elevation showing a gas impermeable mold that can be cast pursuant to another embodiment of the invention.
FIG. 9B is a partial sectioned side elevation showing a similar gas impermeable mold that is cast conventionally.

FIG. 9A illustrates a portion of such a gas impermeable mold 312" that can be used -to centrifugally countergravity cast a bullet-shaped mold cavity 316" with molten metal as described above. Pressure gradient lines 1.0A, 1.1A, 1.2A, 1.3A, 1.4A are shown representing pressure gradient in atmospheres inside the mold 310" rotating at 300 rpm after the molten metal is voided form the riser passage 312" but while the molten metal is still liquid in mold cavities 316"

The pressure gradient will cause the molten metal M" to displace gas in each mold cavity 316" through the associated gate passage 314" as each mold cavity 316" is filled, even from regions of the mold cavity above the gate passage, as long as the gas in the mold cavity 316" has an unobstructed path of ever-decreasing pressure toward the gate passage 314" of that mold cavity 316".

FIG. 9B illustrates a similar gas impermeable mold cavity 316'" filled with molten metal by conventional gravity pouring (ladling) or conventional (non-centrifugal) countergravity casting not pursuant to the invention. Gas will be trapped in regions of the mold cavity above the gate passage 314'". For example, an air pocket P'" is present at the top of the mold cavity 316'". FIG. 9A pursuant to an embodiment overcomes this problem of entrapped gas.

Figure 10:
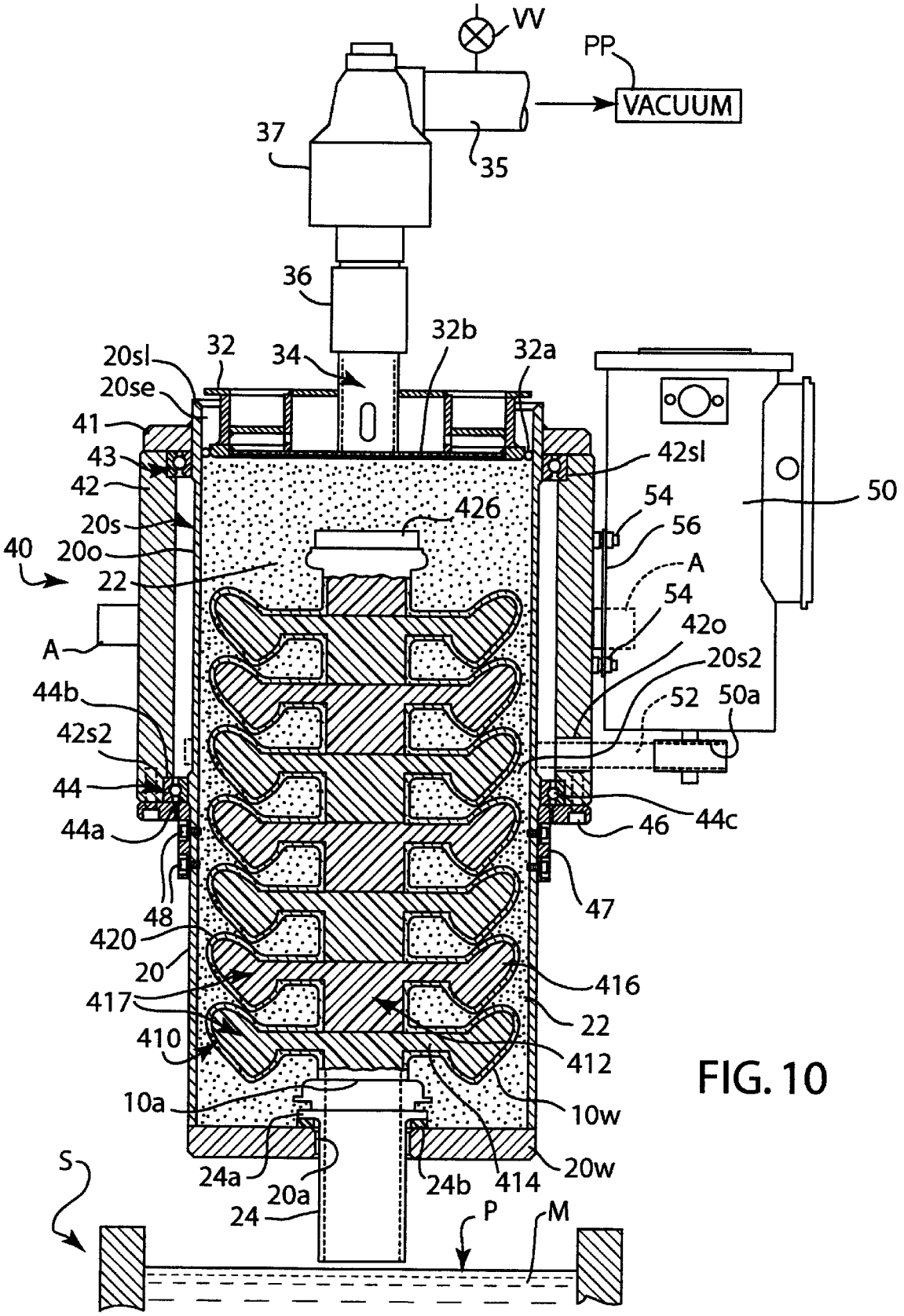
FIG. 10 is a sectioned side elevation of apparatus pursuant to another embodiment of the invention for centrifugal countergravity casting where a fugitive pattern is used in lieu of the shell mold.

Referring to FIG. 10, another embodiment of the invention is illustrated wherein a vaporizable pattern assembly 410 is shown in the container 20 in lieu of shell mold 10. The pattern assembly 410 includes a hollow riser passage-forming portion 412 with a top porous cap 426 and connected by gate passage-forming portions 414 to a plurality of mold cavity-forming portions 416. The pattern assembly 410 is comprised of a plurality of foam plastic pattern rings 417 adhered together with each ring forming riser passage-forming portion 412 connected by gate passage-forming portions 414 to a plurality of mold cavity-forming portions 416. The pattern rings 417 are stacked one top the other and glued together by a suitable adhesive to form the pattern assembly 410. The pattern rings 417 can be cut from as-received expanded polystyrene plate stock or molded by conventional expanded foam technique using expandable polystyrene beads. The pattern assembly 410 is coated on the exterior with a refractory slurry to form a thermally insulative, gas permeable refractory coating 420 thereon. A refractory coating which can be used in practice of the invention is available as Polyshield 3600 available from Borden Chemical Co. This refractory coating comprises mica and quartz refractory material. The coating 420 is applied by dipping the pattern assembly 410 in a slurry of the refractory material, draining excess slurry, and drying the slurry overnight to provide a gas permeable refractory coating on exterior surfaces of the pattern assembly having a thickness in the range of 0.010 to 0.020 inch.

The container 20 with the fugitive pattern assembly 410 can be used in lieu of container 20 and mold 10 of FIGS. 1–3 in practicing of the method of the invention as described above. During casting as described above with the container 20 rotated, the molten metal M is forced to flow upwardly from the pool P into hollow riser passage-forming portion 412 of the pattern assembly 410 by virtue of ambient (atmospheric) pressure on the molten metal M and the subambient pressure in the container 20. The molten metal advances upwardly progressively destroying and replacing the pattern assembly 410 in the particulate medium 22 to form in-situ a riser passage similar to riser passage 12, gate passages similar to gate passages 14 and mold cavities similar to mold cavities 16 described above. Centrifugal pressure will accelerate the movement of the molten metal through the vaporizable pattern to the outside perimeter of the mold cavity formed thereby. The cavities will fill from the outside-in such that liquid and gaseous pattern material (e.g. liquid and gaseous styrene) will be displaced toward the riser passage where at least some of it may escape through the gates. The molten metal in the riser passage is drained as described above before molten metal in the mold cavities and the gate passages solidifies, leaving the gate passages at least partially filled with molten metal for supply to the mold cavities in response to shrinkage as molten metal therein solidifies while the container is rotated. The molten metal in the mold cavities is solidified while rotating the container to form a plurality of individual solidified cast articles in the mold cavities. Rotation of the mold can be terminated after molten metal solidifies in the mold cavities and gate passages.

While the invention has been described in terms of specific embodiments thereof, it is not intended to be limited thereto but rather only to the extent set forth in the following claims.

I claim:

1. A method of countergravity casting a plurality of articles, comprising:

providing a ceramic mold having an upstanding riser passage and a plurality of mold cavities disposed along a length of said riser passage at different elevations, each mold cavity communicating to said riser passage via a gate passage, causing molten metal to flow upwardly from a source into said riser passage for supply to said mold cavities via their gate passages, rotating said mold so that molten metal that resides in said gate passages is subjected to centrifugal force in a direction toward said mold cavities, draining molten metal from said riser passage before molten metal in said mold cavities and said gate passages solidifies, leaving said gate passages at least partially filled with molten metal for supply to said mold cavities in response to shrinkage as molten metal therein solidifies while said mold is rotated, and solidifying molten metal in said mold cavities while rotating said mold to form a plurality of individual solidified cast articles in said mold cavities.

2. The method of claim 1 wherein the steps of causing the molten metal to flow upwardly into said riser passage and of rotating said mold are conducted concurrently during filling of the mold cavities.

3. The method of claim 1 including terminating rotation of said mold after molten metal solidifies in said gate passages.

4. The method of claim 1 wherein said mold includes a fill tube communicated to said riser passage and immersed in said source, said molten metal being flowed upwardly through said fill tube into said riser passage.

5. The method of claim 1 wherein ambient pressure is present in said riser passage after it is drained of molten metal, whereby molten metal partially filling said gate passages and filling said mold cavities is subjected to said ambient pressure plus pressure due to centrifugal motion of said mold.

6. The method of claim 1 wherein said mold is rotated about a longitudinal axis of said mold.

7. The method of claim 1 wherein said mold is rotated about an axis offset from and substantially parallel to a longitudinal axis of said mold.

8. The method of claim 1 wherein said molten metal is flowed upwardly in said riser passage below a center region of an upper closed end of said riser passage.

9. The method of claim 8 wherein molten metal proximate said upper closed end includes a interior void formed generally about a longitudinal axis of said riser passage as a result of centrifugal motion of said mold.

10. The method of claim 9 wherein said interior void in said molten metal reduces pressure surge across said gate passages proximate said upper closed end of said riser passage.

11. The method of claim 1 wherein each mold cavity is elongated in the direction of said riser passage and is connected thereto by a plurality of gate passages.

12. The method of claim 11 including positioning each mold cavity relative to the riser passage that a theoretical melt surface provided by mold rotation passes only through the gate passages during draining of the riser passage but does not pass through the mold cavities so that molten metal is not voided from the mold cavities as the riser passage is drained.

13. The method of claim 11 wherein molten metal is initially solidified at regions between said gate passages so to confine still molten metal in a plurality of compartments in said mold cavity such that said gate passages partially filled with molten metal supply the molten metal to a respective compartment in response to shrinkage as molten metal therein solidifies while said mold is rotated.

14. A method of countergravity casting a plurality of articles, comprising:

providing a ceramic mold having an upstanding riser passage and a plurality of mold cavities disposed along a length of said riser passage at different elevations, each mold.cavity communicating to said riser passage via a gate passage, immersing a fill tube communicated to said riser passage in a pool of molten metal, establishing a subambient pressure in a container in which said mold is disposed with a particulate medium about said mold in said container to cause the molten metal to flow upwardly into said riser passage for supply to said mold cavities via their gate passages, rotating said container with said mold disposed therein while said fill tube is immersed in said pool so that molten metal that resides in said gate passages is subjected to centrifugal force in a direction toward said mold cavities, and draining molten metal from said riser passage before molten metal in said mold cavities and said.gate passages solidifies so as to leave said sprue passage empty proximate said gate passages and to leave said gate passages at least partially filled with molten metal for supply to said mold cavities in response to shrinkage as molten metal therein solidifies while said container and said mold are rotated, withdrawing said fill tube from said pool while rotating said container and said mold, and solidifying molten metal in said mold cavities while rotating said container and said mold to form a plurality of individual solidified cast articles in said mold cavities.

15. The method of claim 14 including terminating rotation of said container and said mold after molten metal solidifies in said gate passages.

16. A method of countergravity casting a plurality of articles, comprising:

providing a fugitive pattern having an upstanding riser passage-forming portion and a plurality of mold cavity-forming portions disposed along a length of said riser-passage-forming portion, each mold cavity-forming portion being connected to said riser passage-forming portion via an gate passage-forming portion, a particulate medium disposed about said pattern in a container, causing molten metal to flow upwardly from a source into said riser passage-forming portion for supply to said mold cavity-forming portions via their gate passage-forming portions, rotating said container and said pattern so that molten metal that resides in said gate passage-forming portions is subjected to centrifugal force in a direction toward said mold cavity-forming portions, draining molten metal from a, riser passage formed by destruction of said riser passage-forming portion before molten metal in mold cavities and gate passages formed by destruction of said mold cavity-forming portions and said gate passage-forming portions solidifies so as to leave said gate passages at least partially filled with molten metal for supply to said mold cavities in response to shrinkage as molten metal therein solidifies while said container is rotated, and solidifying molten metal in said mold cavities while rotating said container to form a plurality of individual solidified cast articles in said mold cavities.

17. The method of claim 16 including terminating rotation of said container after molten metal solidifies in said gate passages.

18. The method of claim 16 wherein said pattern includes a fill tube communicated to said riser passage-forming portion and immersed in said source, said molten metal being flowed upwardly through said fill tube to said riser passage-forming portion.

19. The method of claim 16 wherein ambient pressure is present in said riser passage after it is emptied of molten metal, whereby molten metal partially filling said gate passages and said mold cavities is subjected to said ambient pressure plus pressure due to centrifugal motion of said container.

20. The method of claim 16 wherein said container is rotated about a longitudinal axis of said pattern.

21. The method of claim 16 wherein said container is rotated about an axis offset from and substantially parallel to a longitudinal axis of said pattern.

22. The method of claim 16 wherein each mold cavity-forming portion is elongated in the direction of said riser passage-forming portion and is connected thereto by a plurality of gate passage-forming portions.

23. The method of claim 22 including positioning each mold cavity-forming portion relative to the riser passage that a theoretical melt surface provided by mold rotation passes only through the gate passages during draining of the riser passage but does not pass through the mold cavities so that molten metal is not voided from the mold cavities as the riser passage is drained.

* * * * *